United States Patent [19]

Loseff

[11] 4,057,731

[45] Nov. 8, 1977

[54] STERILE CONTAINER FOR X-RAY CASSETTE HOLDERS

[76] Inventor: Herbert S. Loseff, 308 Woodley Road, Winnetka, Ill. 60093

[21] Appl. No.: 756,918

[22] Filed: Jan. 5, 1977

Related U.S. Application Data

[63] Continuation-in-part of Ser. No. 613,531, Sept. 15, 1975, abandoned.

[51] Int. Cl.[2] ..... H05G 1/00

[52] U.S. Cl. ..... 250/475

[58] Field of Search ..... 250/475, 472, 482, 44; 206/813, 454, 455

[56] References Cited

U.S. PATENT DOCUMENTS

| | | | |
|---|---|---|---|
| 2,335,015 | 11/1943 | Lantheaume | 206/813 |
| 3,635,450 | 1/1972 | Schneider | 206/813 |
| 3,829,699 | 8/1974 | Anspach | 250/475 |

*Primary Examiner*—Alfred E. Smith
*Assistant Examiner*—B. C. Anderson
*Attorney, Agent, or Firm*—Allegretti, Newitt, Witcoff & McAndrews

[57] ABSTRACT

An improved sterile container is disclosed for receiving and enclosing an unsterile x-ray cassette holder so as to avoid contamination of a sterile operative field by the unsterile x-ray cassette holder when the cassette holder is being used to take x-rays during surgery in a sterile operative field.

The improved container includes sterile fastening means for properly positioning the x-ray cassette holder with respect to the patient to be x-rayed so as to obtain optimal x-ray views without unnecessarily exposing any operating room personnel to the x-rays and so as to minimize the chances that the x-ray cassette holder will slip or otherwise move, with respect to the patient, during the time the x-rays are being taken. The sterile fastening means serves both to properly position the x-ray cassette holder with respect to the patient and to properly position and maintain the position of the patient to be x-rayed with respect to the x-ray cassette, both without the need for operating room personnel to hold the container or the cassette holder during exposure of the x-ray film. The sterile fastening means, in one preferred embodiment of the invention, comprises a sterile adhesive tape which permits the sterile container having the unsterile x-ray cassette holder therein to be secured to the portion of the patient to be x-rayed without danger of the container moving or being moved, relative to the patient, during the time that the x-ray film is being exposed.

7 Claims, 7 Drawing Figures

Fig. 1
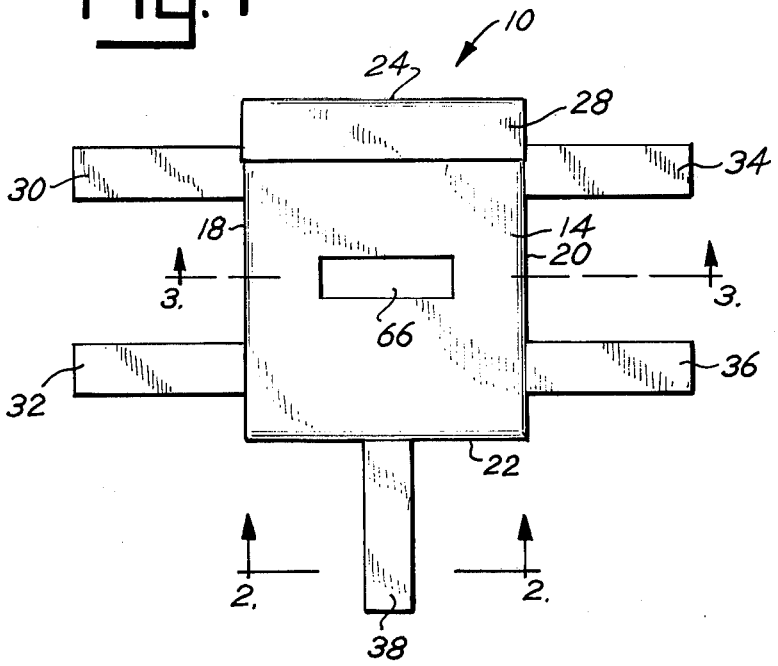
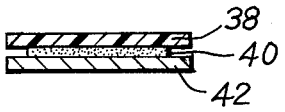
Fig. 2
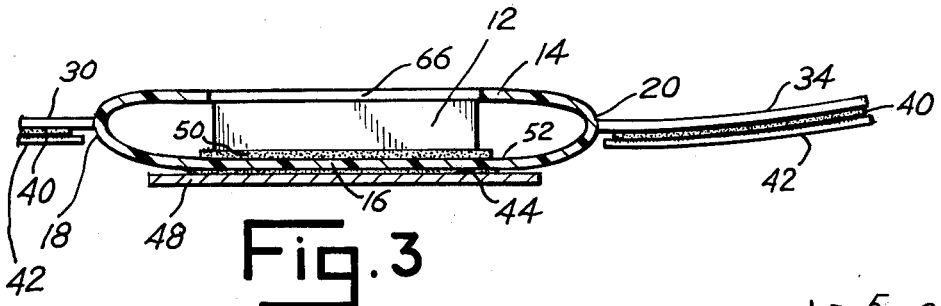
Fig. 3
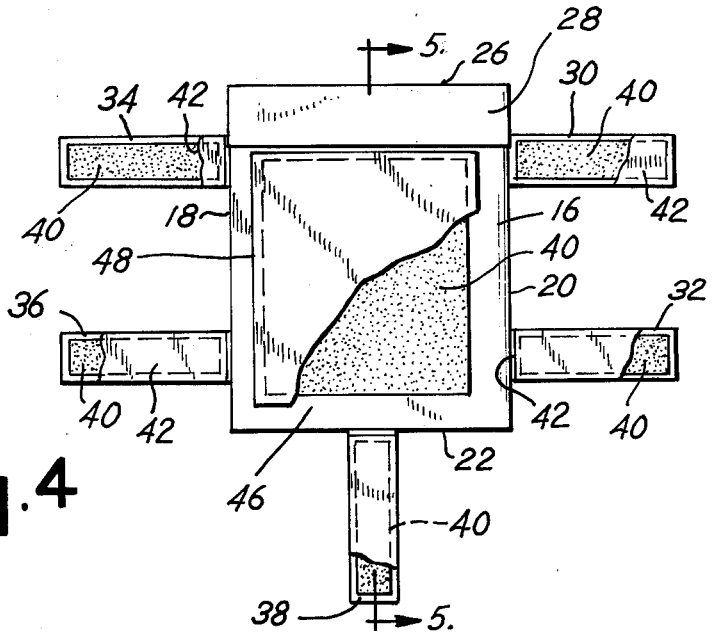
Fig. 4

STERILE CONTAINER FOR X-RAY CASSETTE HOLDERS

This application is a continuation-in-part of my earlier filed application, Ser. No. 613,531, filed Sept. 15, 1975, abandoned.

BACKGROUND AND SUMMARY OF THE INVENTION

The present invention relates to a container for x-ray cassette holders and the like, and more particularly, to an improved sterile container for receiving and enclosing a non-sterile x-ray cassette holder and the like so as to avoid contamination of a sterile operative field by the non-sterile x-ray cassette holder when the x-ray cassette holder is utilized to take x-rays in the sterile operative field during surgery.

For years, it has been general practice to take x-rays of a patient during and after the completion of surgery, and particularly orthopedic surgery, in order to obtain information as to the position of the bones, or for example, of implanted metallic fixations, and in order to obtain a permanent record of the results of the surgery. The x-ray film utilized to take the x-rays has been and is still generally held in x-ray cassette holders having a standard, generally rectangular configuration. As a practical matter, these x-ray cassette holders cannot be sterilized, and it has long been recognized that precautions must be taken when the non-sterile x-ray cassette holders are introduced into the sterile operative field during surgery so as not to contaminate the operative field.

In the past, the accepted practice was to place the unsterile x-ray cassette holders within a sterilized cotton pillow case or mayo table stand cover (actually, an elongated pillow case) prior to the cassette holder being used to take the x-rays during surgery. While such pillow cases or mayo table stand covers generally afforded a somewhat adequate protection against contamination, these cloth pillow cases and cover have the disadvantage that they are pervious to fluids, such as blood and the like, and the leakage of such fluids into pillow cases and covers can cause loss of sterility in the operative field.

Recently plastic, flexible containers have been utilized to enclose unsterile x-ray cassette holders in the sterile operative field, as shown for example in U.S. Pat. No. 3,843,041. While the use of the plastic containers represents an improvement over the use of the cloth pillow cases and mayo table stand covers in that they are impervious to fluids, the presently available plastic containers share a serious disadvantage with the pillow cases and mayo table stand covers. When x-rays are taken in the operative field, the patient is normally unconscious or semi-conscious, and it is difficult to properly position the x-ray cassette holder, enclosed in a container, whether plastic or cotton, so as to provide optimal x-ray views (e.g. standard anterio-posterior and lateral views) without holding the cassette holder.

Commonly the practice has been to prop the x-ray cassette holder against the patient by using sheets or towels, etc. Nevertheless, the patient will oftentimes involuntarily or voluntarily move or the cassette holder will otherwise slip or move relative to the patient after the x-ray holder has been positioned but before the x-ray can be taken. In an attempt to avoid obtaining less than optimal x-ray views because of patient movement or slippage of the cassette holder, x-ray cassette holders were sometimes held in position by the surgeon or one of the other operating room personnel. However, because of fear of repeated x-ray exposures, more and more operating personnel are reluctant to hold the x-ray cassette holders while an x-ray exposure is made. As a result of these problems, surgeons have often, in practice, had to settle for a less than optimal x-ray view.

It is a primary object of my present invention to provide an improved sterile container for receiving and enclosing a non-sterile x-ray cassette holder and the like, which container comprises sterile means for positioning the container, and the x-ray cassette holder therein, with respect to the patient so as to minimize the chances that the cassette holder will slip or otherwise move, with respect to the patient, during the time that the x-rays are being taken and to obviate the need for the operating room personnel to have to hold the container or the cassette holder during exposure of the x-ray film. More specifically, my improved container for x-ray cassette holders and the like includes flexible front and back walls which are joined together along their side and bottom edges and whose top edges define a closable opening for receiving a cassette holder. Sterile fastening means are provided to properly position and maintain the container relative to the patient, and to position and maintain the patient relative to the container. In one illustrative embodiment, which is not to be deemed to limit the forms by which the invention can be manifested, the invention comprises a first pair of sterile straps secured, at their one ends, to the container adjacent to one side edge of the container and extending outwardly from the container. A second pair of sterile straps are secured, at their one ends, to the container along its other side edge and extend from the container in a direction opposite to that of the first pair of straps. Another sterile strap is secured, at its one end, to the container adjacent to its bottom edge and extends from the container.

Each of these sterile straps has a strip of adhesive material applied to one of its surfaces. The outer surface of one of the container walls includes a first zone to which adhesive material has also been applied, with the outer surface of the one container wall facing in the same direction as the one surfaces of the straps. Through the usage of the sterile straps and the first zone of adhesive material, my improved container may be secured to the portion of the patient to be x-rayed without danger of the container moving or being moved, relative to the patient, during the time that the x-ray film is being exposed. Pullaway protective covers overlay each of the adhesive strips and the first zone and may be removed from the straps and the one wall of the container just prior to the securement of my improved container to a patient.

In another embodiment of my improved container, a second zone of adhesive material is applied to the inside surface of the one wall of the container so as to secure the cassette holder to the container. This second zone of adhesive material extends from adjacent to the top edge of the one container wall toward the bottom edge of the container wall and also serves as the means by which the top edges of the front and back container walls may be secured together after a cassette holder has been inserted into the container. As with the first zone of adhesive material, a selectively removable, pull-away protective cover overlies the second zone of the adhesive material so as to facilitate storage of the container prior to usage. This protective cover is designed to be manually pulled away from the underlying adhesive material immediately prior to the insertion of a cassette holder into the container.

In still another alternative embodiment of my present invention, the second zone of adhesive material is omitted. A layer of adhesive material is applied to each of the side surfaces of the x-ray cassette holder to be enclosed within the container and each of these layers of adhesive material has an overlying, pull-away, protective cover. When the cassette holder is to be inserted into the container, the cover protecting one of the layers of adhesive material is pulled away. The cassette holder is introduced into the container, properly positioned therein and then brought into contact with the container wall adjacent to the uncovered layer of adhesive material so that the cassette holder is secured to the container wall. The protective cover overlying the other layer of adhesive material is then removed and the container wall adjacent to the other layer is pressed against the cassette holder, thus firmly securing the x-ray cassette holder within to the container. The open top edges of the container walls, in this alternative embodiment, are closed by a flap which is integrally formed adjacent to one of the top edges and which is designed to be folded over the top edge of the other container wall, after the cassette holder has been inserted into the container, and to be secured to the other container wall by adhesive material applied to the flap.

The improved sterile container of my present invention has a number of commercially important advantages. The container may be manufactured from flexible plastic material at a relatively low cost. This is of consequence since thirty to forty such containers may be required each week by a surgeon. Moreover, my improved container may be sterilized during manufacture and may, itself, be sealed in a package for transport from the manufacturing facility to the hospital. Furthermore, because of its relatively low manufacturing cost, the container can be readily disposed of after usage. This "pre-sterilization" and the "disposability" of my container minimize the work required by the operating personnel and hospital staff and with today's ever increasing hospital costs, this is of particular significance from the standpoint of commercializing my improved container.

These and other objects and advantages of my present invention will become more apparent in view of the following detailed description of the preferred embodiments of my invention described in connection with the accompanying drawings.

DESCRIPTION OF THE DRAWING

FIG. 1 is a plan view of one side of a container embodying the principles of my present invention.

FIG. 2 is a cross sectional view taken along the line 2—2 in FIG. 1.

FIG. 3 is a vertical cross sectional view taken along the line 3—3 in FIG. 1 and showing an x-ray cassette holder being disposed within the container.

FIG. 4 is a plan view of the side of the container opposite from that shown in FIG. 1.

Figure 7:
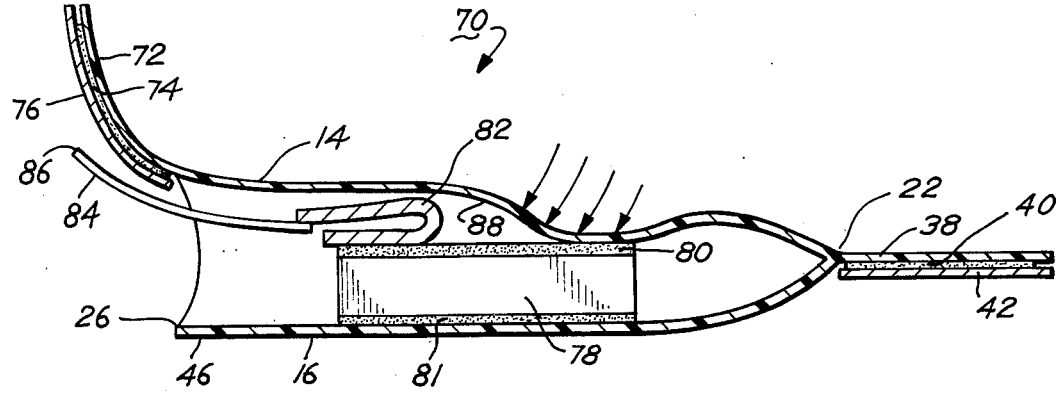
FIG. 7 is a longitudinal, vertical cross sectional view, similar to that shown in FIG. 6, showing another container embodying the principles of my present invention.
Figure 5:
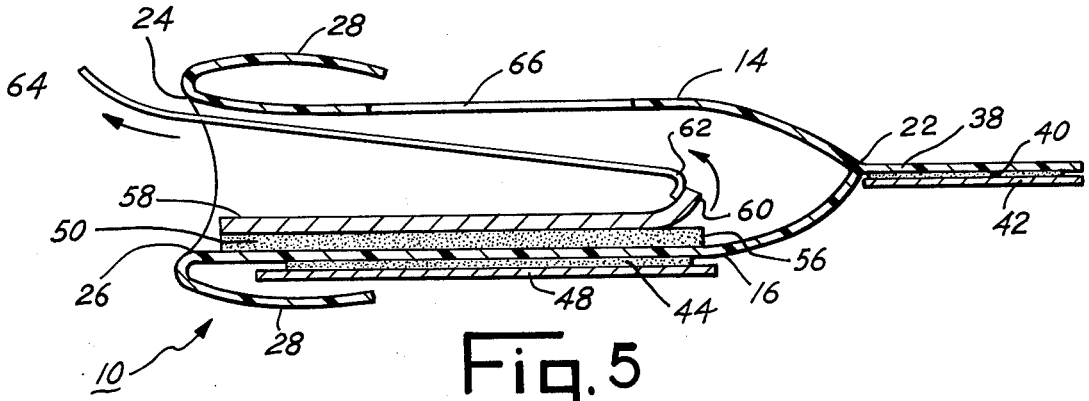
FIG. 5 is a cross sectional view taken along the line 5—5 in FIG. 4.
Figure 6:
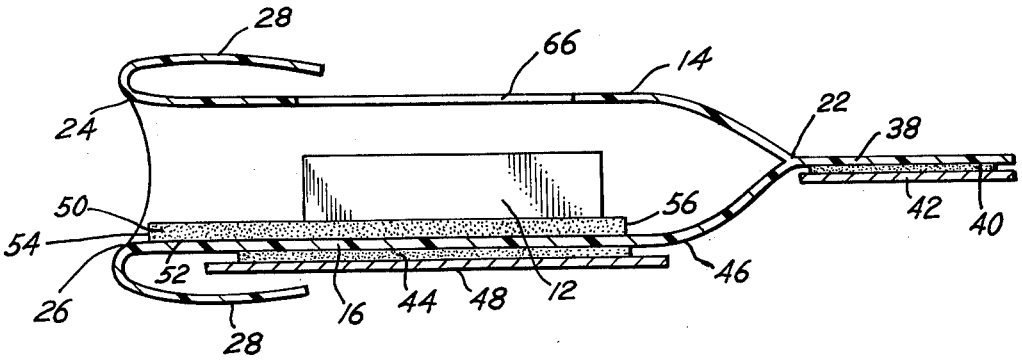
FIG. 6 is a view similar to that shown in FIG. 5 and showing an x-ray cassette holder being disposed within the container.

Throughout the various figures of the drawings, the same reference numerals will be used to designate the same parts or components. Moreover, when the terms "right," "left," "front," "back," "inside," "outside," "bottom," "top," and "side" are used herein, it is to be understood that these terms have reference to the structure shown in the drawings, as it would appear to a person viewing the drawings, and are utilized only to facilitate the description of my present invention.

DESCRIPTION OF THE PREFERRED EMBODIMENTS

Referring now to FIGS. 1–6, one form of an improved sterile container embodying the principles of my present invention is shown generally at 10. As noted above, the container 10 is adapted to receive and enclose a non-sterile x-ray cassette holder 12 while the x-ray film carried in the cassette holder is being exposed during surgery in a sterile operative field. More specifically, the cassette holder 12 is of conventional design and construction. The holder 12 functions to receive an x-ray film cassette and includes two relatively large, rectangular side surfaces, one of which includes an opening and means for securing the x-ray film cassette within the holder 12. The cassette holder 12 cannot, as a practical matter, be sterilized, and therefore, must be enclosed in some sort of sterile container in order to avoid contaminating a sterile operative field while the holder is being used to take x-rays of a patient in the operative field. Because the design and construction of the x-ray cassette holder 12 are conventional and do not comprise a part of my invention, a further detailed description of the holder 12 has been omitted.

The container 10 includes front and rear walls 14 and 16, respectively, that are joined together along their side edges 18 and 20 and along their bottom edges 22, so as to define a container having an upper open end. The walls 14 and 16 may be made from any flexible, liquid impervious material, such as a polyvinylchloride plastic or treated paper. Although in the past the material used for the walls of containers for cassette holders has been opaque, the material can also be clear to permit visual inspection of the holder in the container.

As best shown in FIGS. 1, 4, 5 and 6, the top or upper edges 24 and 26 of the walls 14 and 16, respectively, are normally open and may be spread apart so as to permit the holder 12 to be inserted within the container 10. A continuous cuff or flap 28 is formed as integral part or extension of the edges 24 and 26 and extends completely around the periphery of the upper end of the container 10. The cuff 28 is folded downwardly, towards the bottom edge 22, the overlies the upper portions of the walls 14 and 16 a sufficient distance so as to provide a protective covering for a person's hands and fingers. More specifically, the cuff 28 is designed so that a person may grasp the container 10, with both hands, adjacent to the top edges 24 and 26 and be able to spread or open the upper end of the container so as to enable the holder 12 to be placed within the hands of the person grasping the container against accidental engagement or contact with the unsterile holder 12 while it is being inserted into the container 10.

A first pair of sterile straps 30 and 32 are secured, at their one ends, to the container 10 adjacent to its one side edge 18. The straps 30 and 32 may be separate pieces of flexible material or may be formed as an integral part of the walls of the container. The other, distal ends of the sterile straps 30 and 32 project outwardly from the side edge 18 and are relatively movable with respect to the container. A second pair of sterile straps 34 and 36 are secured, at their one ends, to the container adjacent to its other side edge 20. Like sterile straps 30 and 32, the sterile straps 34 and 36 may be separate pieces of flexible material or may be formed as an integral part of the walls of the container 10. The other, distal ends of the straps 34 and 36 project outwardly from the side edge 20 of the container and are relatively movable with respect to the container. Another sterile strap 38 is secured, at its one end, to the container 10 adjacent to the bottom edge 22 of the container and midway between the side edges 18 and 20. The other distal end of the sterile strap 38 projects outwardly from the bottom edge 22 of the container and is relatively movable with respect to the container.

All of the sterile straps 30, 32, 34, 36 and 38 are substantially identical in structure and function, and are designed to be utilized to attach the container to the patient to be x-rayed. The importance of maintaining the sterility of these straps during x-ray in a sterile operative field will be fully appreciated by those skilled in the art. To facilitate attachment, each of these sterile straps has a strip 40 of adhesive material applied to one surface thereof. Preferably and as best shown in FIG. 4, the one surfaces of the straps, i.e., the surfaces to which the strips of adhesive material are applied, all face in the same direction. The adhesive material in the strips 40 is of a conventional composition and may be of a type which readily adheres to the skin or to cloth but which does not adhere to the skin so tightly as to make it difficult and painful to remove the straps from the patient.

Prior to the use of the container in an operative field a selectively removable, pull-away protective cover 42 is placed over each of the strips 40 of adhesive material so as to completely cover and protect the underlying adhesive material. These protective covers 42 are adopted to be readily manually pulled away or off of the strips of adhesive material immediately prior to use of the container. When the covers 42 have thus been pulled away, the strips 40 of adhesive material are ready to be pressed against the skin or clothing of the patient so as to attach the container 10 to the patient. The inclusion of the protective covers 42 facilitate the storage and handling of the container prior to its usage.

To further facilitate the attachment of the container 10 to a patient, a first generally rectangular zone 44 of the adhesive material may be centrally applied to a portion of the outside facing surface 46 of the container real wall 16 between the lower edge of the cuff 28 and the bottom edge 22 and between the side edges 18 and 20. The adhesive material comprising the first zone 44 is of the same composition as the adhesive material used in the strips 40. Similarly, a removable, pull-away protective cover 48 overlies the adhesive material comprising the first zone 44 prior to the usage of the container.

A second generally rectangular zone 50 of adhesive material is applied to the inside facing surface 52 of the real wall 16. The second zone 50 has its upper edge 54 disposed adjacent to the top edge 24 of the wall 16, and its lower edge 56 extends toward, but is spaced from, the bottom edge 22 of the container. The adhesive material utilized for this second zone 50 is of the same composition as the adhesive in the first zone 44 and in the strips 40. The side edge portions of of the second zone 50 are spaced inwardly from the side edges 18 and 20 of the container. The zone 50 is adapted to secure the cartridge holder 12 to the container 10 after the holder 12 has been inserted into the interior of the container. In other words, the second zone 50 is used to prevent relative movement between the holder 12 and the container 10 after the holder 12 has been inserted into the container. The second zone is also utilized to secure the top edges 24 and 26 together after the holder 12 has been disposed within the container 10. Thus, the portion of the front wall 14, adjacent to its top edge 24, may be pressed against the portion of the second zone 50, adjacent to its upper edge 54 so as to thereby secure the top edges 24 and 26 together.

A removable, pull-away protective cover 58 overlies the second zone 50 prior to usage of the container 10. The protective cover 58 is similar, in structure and function, to the protective cover 48 except that a tab or light string 62 is secured to the lower or bottom edge 60 of the cover 58, i.e. the edge which overlies the bottom edge 56 of the second zone 50. The other distal end 64 of the tab or string 62 extends outside the container 10 and is adapted to be grasped and pulled from without the container. The tab 62 facilitates removal of the cover 58 since by pulling on the tab, the protective cover 58 will be removed from the second zone 50 without the necessity of a person reaching into the container and directly pulling the protective cover away. In this connection, the protective cover 58 is generally removed from the second zone 50 after top edges 24 and 26 of the container have been manually spread apart preparatory to the insertion of the holder 12. The tab 62 is then pulled so as to remove the protective cover 58 and ready the second zone 50 for the contact with the side of the holder 12 when the holder is placed within the container.

As noted above, the walls 14 and 16 may be made of opaque material and in such a situation, a transparent window 66 may be disposed in the front wall 14. The window 66 is centrally located and permits visual inspection of the holder 12 within the container 10 after the top edges 24 and 26 of the container have been secured together. Such visual inspection is important since it permits the surgeon to be sure that the proper side surface of the x-ray cassette holder 12 is placed toward the patient and the x-ray source. Improper placement of the holder 12 may result in no x-ray or a poor quality x-ray, obscured with the overlying metallic straps, etc. used to secure the x-ray film cassette within the holder 12. The window 66 may be made from a flexible, clear plastic or the like.

The sterility of the container 10 and the fastening means may be achieved after they have been made but before usage, by sterilizing the combination in a conventional manner. Preferably, the container is then placed in a conventional sealed package, not shown, that protects the sterility of the container while it is being shipped to the hospital or place of use. The container is removed just before the container is brought into the sterile operative field.

Another container embodying the principles of my present invention is shown generally at 70 in FIG. 7. The container 70 is structurally and functionally identical to the container 10 except as noted hereinafter. In this regard, the container 70 does not include a cuff 28 but rather has a flap 72 which is integrally formed with and extends from the top edge 26 of the rear wall 16. A strip 74 of adhesive material is applied to the inside facing surface of the flap 72 and is protected, prior to usage, by a selectively removable pull-away protective cover 76. The adhesive material comprising the strip 74 is of the same composition as that used in the strips 40.

The container 70 also does not include the first and second zones 44 and 50 of adhesive material. Instead, the container 70 is designed for use with a modified x-ray cassette holder 78 structurally and functionally identical to the holder 12 except that it has two layers 80 and 81 of adhesive material applied to its large rectangular surfaces.

Prior to usage, the layers 80 and 81 are protected by identical, removable, pull-away protective covers, one of which being shown at 82. A tab or string 84 is secured at one end to an edge of each of the protective covers 82. The tab 84 is of sufficient length that its other distal end 86 is adapted to be disposed without the container 70 and is arranged so that the holder 78 is secured to the wall 16. Next the other cover 82 is removed by pulling the tab 84. After the second protective cover 82 has thus been removed from the layer 80, the inside facing surface 88 of the wall 14 is pressed against the adhesive layer 80 so as to secure the holder 78 to the container 70. After the holder 78 is thus disposed within the container 70, the protective cover 76 is removed from the strip 74, and the flap may be manually folded around the top edge 24 of the front wall 14 and brought into surface-to-surface contact with the upper portion of the outside facing surface 46 of the front wall 14 so as to close and secure the upper end of the container 70.

From the foregoing, it should be apparent to those having skill in this art that my improved containers 10 and 70, as described hereinabove, afford a relatively inexpensive means for enclosing an unsterile x-ray cassette holder during its use in a sterile operative field while minimizing the chances that the unsterile cassette holder will contaminate the operative field. When it is desired to use a container, such as the container 10, a person in the operative field picks up the container and grasps it with both hands under the cuff 28 and manually spreads the top edges 24 and 26 apart. Another person may then insert the cassette holder within the interior of the container while being careful not to have the cassette holder contact the exterior of the container. The cuff 28 protects the hands of the person holding the container against accidental contact between his hands and the holder. Immediately prior to the insertion of the cassette holder 12 into the container 10, the protective cover 58 is removed from the zone 50 of adhesive material by pulling the tab 58. Thus, as soon as the cassette holder is placed into the container, it may be brought into contact with the zone 50 so as to be secured thereto and to thereby prevent any relative movement between the holder and the container. After the insertion of the holder 12 into the container 10, the person holding the container may press the top edges 24 and 26 of the container walls 14 and 16 together so that the inside surface of the front wall 14 is pressed against the upper portion of the zone 50.

Thereafter, the protective covers 42 and 48 are removed from the strips 40 and first zone 44 so that the sterile straps 30–38 may be utilized to attach the container to the patient for the purpose of obtaining optimal x-ray views. The use of the sterile straps 32, 34, 36 and 38 and the first zone 44 assures that the container 10 will be attached to the patient so as to avoid the possibility that there will be slippage or relative movement between the container 10 and the patient after the container, and thus the cassette holder 12 has been once properly positioned by the surgeon.

Lastly, it should also be obvious to those having skill in this art that changes or modifications could be made in my improved containers 10 and 70. For example, additional or fewer sterile straps 30–38 could be utilized and the shapes of the zones 44 and 50 could be modified. Likewise, the containers could be formed out of an integral piece of material rather than from separate pieces of material secured together along their side and bottom edges. Thus, since the invention disclosed herein may be embodied in other specific forms without departing from the spirit of central characteristics thereof, the preferred embodiments described herein are therefore to be considered in all respects as illustrative, and not restrictive, the scope of my invention being indicated by the appended claims, rather than by the foregoing descriptions, and all changes which come within the meaning and range of equivalency of claims are therefore intended to be embraced therein.

I claim:

1. An improved sterile container for receiving and completely enclosing a non-sterile x-ray cassette holder so as to avoid the contamination of a sterile operative field by the non-sterile x-ray cassette holder when the x-ray cassette holder is utilized to take x-rays in the sterile operative field during surgery, the improved sterile container comprising:

a pair of relatively flexible walls, each having an inside surface, an outside surface, side edges, a bottom edge and a top edge and each being arranged so that their inside surfaces face each other, with the bottom and side edges of one of the flexible walls being aligned and connected with the corresponding bottom and side edges of the other flexible wall so as to form a container having closed sides and a closed bottom end and with the top edges of the flexible walls being adjacent to each other so as to define a top end which may be selectively opened or closed and which when opened is adapted to receive an x-ray cassette holder for insertion into the interior of the container;

sterile fastening means for permitting the container having an x-ray cassette holder disposed therein to be selectively secured to a patient while an x-ray is being taken, the said sterile fastening means serving to position the x-ray cassette relative to the patient and to maintain the patient relative to the x-ray cassette during the x-ray exposure, and means for selectively holding the top end of the container closed so as to enclose an x-ray cassette holder within the container.

2. An improved sterile container in accordance with claim 1 wherein said sterile fastening means comprises: a first strap secured at one end to the container adjacent one of the side edges of the container extending outwardly from the one side edge of the container; a second strap secured at one end to the container adjacent the other side edge of the container and extending outwardly from the other side edge of the container; each strap having a strip of adhesive material on one of its surfaces facing in the same direction as the outside surface of one of the flexible walls of the container; and each adhesive strip being covered, prior to use, by a selectively removable pull-away protective cover.

3. An improved sterile container in accordance with claim 1 further comprising means for selectively securing an x-ray cassette holder to the inside surface of one flexible wall of the container after the x-ray cassette holder has been received within the container.

4. An improved sterile container in accordance with claim 1 wherein said sterile fastening means for securing the container to a patient also includes a first zone of adhesive material that is applied to the outside surface of one flexible wall of the container, and wherein, prior to use, the first adhesive zone is covered by a selectively removable, pull-away protective cover.

5. An improved sterile container in accordance with claim 4 wherein the means for holding the top end of the container closed and the means for selectively securing the x-ray cassette holder to the inside surface of one flexible wall of the container includes a second zone of adhesive material that is applied to the inside surface of the one flexible wall, with the second adhesive zone extending from adjacent to the top edge of the one flexible wall toward the bottom edge of the one flexible wall; wherein prior to use, the second adhesive zone is covered by a selectively removable, pull-away protective cover; wherein when the protective cover has been removed from the second adhesive zone, the x-ray cassette holder may be pressed against and secured to the second adhesive zone; and wherein when the protective cover has been removed from the second adhesive zone, the part of the inside surface of the other flexible wall, adjacent to and along the top edge of the other flexible wall, may be brought into contact with the top portion of the second adhesive zone, adjacent to the top edge of the one flexible wall whereby the container may be sealed along its top edge.

6. An improved sterile container in accordance with claim 1 wherein the sterile fastening means for securing the container to a patient includes: a first pair of straps which are attached, at their one ends, to the container adjacent to one of the side edges of the container and which extend outwardly from the one side edge of the container; a second pair of straps which are attached, at their one ends, to the container adjacent to the other side edge of the container and which extend outwardly from the other side edge of the container; and a third strap which is attached, at its one end, to the container and which extends outwardly from the bottom end of the container; wherein each strap has a strip of adhesive material applied to the surface thereof that faces in the same direction as the outside surface of the one flexible wall; and wherein prior to use, each adhesive strip is covered by selectively removable pull-away protective cover.

7. An improved sterile container in accordance with claim 6 wherein the walls are opaque; and wherein the other flexible wall includes means for permitting visual inspection of an x-ray cassette holder disposed within the container.

* * * * *